US009915431B2

(12) United States Patent
Vasquez-Del-Mercado et al.

(10) Patent No.: US 9,915,431 B2
(45) Date of Patent: Mar. 13, 2018

(54) GAS PILOT BURNER ASSEMBLY

(71) Applicant: Honeywell International Inc., Morristown, NJ (US)

(72) Inventors: Victor Vasquez-Del-Mercado, Chula Vista, CA (US); Rene Meillon, Tijuana (MX); Gerardo Lopez, Tijuana (MX)

(73) Assignee: Honeywell International Inc., Morris Plains, NJ (US)

( * ) Notice: Subject to any disclaimer, the term of this patent is extended or adjusted under 35 U.S.C. 154(b) by 813 days.

(21) Appl. No.: 13/831,091

(22) Filed: Mar. 14, 2013

(65) Prior Publication Data

US 2014/0272742 A1 Sep. 18, 2014

(51) Int. Cl.

| | |
|---|---|
| ***F24C 3/10*** | (2006.01) |
| ***B23P 19/00*** | (2006.01) |
| ***F23Q 9/00*** | (2006.01) |
| ***F23D 14/46*** | (2006.01) |
| ***F23D 14/70*** | (2006.01) |
| ***F23D 14/84*** | (2006.01) |

(52) U.S. Cl.

CPC ..... *F24C 3/106* (2013.01); *F23D 14/46* (2013.01); *F23D 14/70* (2013.01); *F23D 14/84* (2013.01); *F23D 2207/00* (2013.01); *F23D 2209/00* (2013.01); *F23D 2900/00014* (2013.01); *F23N 2031/08* (2013.01); *Y10T 29/49826* (2015.01); *Y10T 29/49963* (2015.01)

(58) Field of Classification Search

CPC . F23Q 9/00; F23D 14/84; F23D 14/70; F23D 14/46; F23D 2207/00; F24C 3/106; F23N 2031/08

USPC ..... 248/200; 431/287, 343

See application file for complete search history.

(56) References Cited

U.S. PATENT DOCUMENTS

| | | | |
|---|---|---|---|
| 2,011,412 | A | 8/1935 | Masoner |
| 2,609,870 | A | 9/1952 | Riebman et al. |
| 2,665,749 | A | 1/1954 | Ebeltoft |
| 2,753,930 | A | 7/1956 | Fleury |
| 2,859,263 | A | 11/1958 | Glickman |
| 2,884,009 | A | 4/1959 | Hetherington |
| 3,052,286 | A | 9/1962 | Kramer et al. |

(Continued)

FOREIGN PATENT DOCUMENTS

| | | |
|---|---|---|
| CA | 2262196 | 9/1999 |
| EP | 0990850 | 4/2000 |

(Continued)

OTHER PUBLICATIONS

"Q345A1008/U," p. 1, printed Mar. 25, 2013. http://customer.honeywell.com/en-US/Pages?Product.aspx?cat=HonECCCatalog&pid=Q345A1008/U&category=Q345&catpath=1.2.1.16#.

(Continued)

*Primary Examiner* — Avinash Savani
*Assistant Examiner* — Rabeeul Zuberi
(74) *Attorney, Agent, or Firm* — Seager, Tufte & Wickhem, LLP

(57) ABSTRACT

A pilot tube assembly for easy repair and/or replacement of a pilot hood is disclosed. In one example, a field configurable burner tube assembly may include a burner tube, a pilot hood, wherein the pilot hood engages the burner tube and can be secured to the burner tube in any of two or more different orientations in the field, a thermo-electric device, and a bracket for carrying the pilot hood and burner tube assembly adjacent to the thermoelectric device.

3 Claims, 10 Drawing Sheets

(56) References Cited

U.S. PATENT DOCUMENTS

| | | | | |
|---|---|---|---|---|
| 3,056,450 | A | 10/1962 | Loveland et al. | |
| 3,145,763 | A | 8/1964 | Loveland | |
| 3,147,343 | A | 9/1964 | Meyer et al. | |
| 3,159,203 | A | 12/1964 | Aldo | |
| 3,173,472 | A * | 3/1965 | Loveland | 431/80 |
| 3,208,505 | A | 9/1965 | Craemer | |
| 3,290,178 | A | 12/1966 | Loveland | |
| 3,291,186 | A | 12/1966 | Lindberg | |
| 3,313,564 | A | 4/1967 | Pultz | |
| 3,519,491 | A * | 7/1970 | Grohall | F23Q 9/04 136/217 |
| 3,620,849 | A | 11/1971 | Thompson et al. | |
| 3,650,843 | A * | 3/1972 | Kenyon | 136/217 |
| 3,825,183 | A | 7/1974 | Machlanski | |
| 3,920,178 | A * | 11/1975 | Moller | B65D 85/324 206/521.8 |
| 3,943,616 | A * | 3/1976 | Smith | F16L 25/08 285/90 |
| 3,992,137 | A * | 11/1976 | Streisel | F23D 14/725 239/433 |
| 4,165,963 | A | 8/1979 | Nozaki | |
| 4,177,034 | A | 12/1979 | Jones | |
| 4,325,690 | A | 4/1982 | Hayes | |
| 4,337,029 | A * | 6/1982 | McElroy | F23Q 9/04 174/153 G |
| 4,565,521 | A | 1/1986 | Hancock | |
| 4,783,029 | A | 11/1988 | Geppert et al. | |
| 4,829,983 | A | 5/1989 | West et al. | |
| 5,039,300 | A | 8/1991 | Riehl | |
| 5,051,089 | A | 9/1991 | Jayaram | |
| 5,275,555 | A | 1/1994 | Goodridge | |
| 5,613,830 | A | 3/1997 | Chan et al. | |
| 6,027,335 | A | 2/2000 | Griffioen | |
| 6,056,540 | A | 5/2000 | Newman et al. | |
| 6,059,562 | A | 5/2000 | Anderson, II | |
| 6,293,784 | B1 | 9/2001 | Griffioen | |
| 6,547,277 | B1 | 4/2003 | Adamini et al. | |
| 6,732,677 | B2 | 5/2004 | Donnelly et al. | |
| 7,300,278 | B2 | 11/2007 | Vandrak et al. | |
| 7,902,457 | B2 * | 3/2011 | Johnson | 174/61 |
| 2002/0145095 | A1 * | 10/2002 | Winkler | A63B 57/00 248/300 |
| 2006/0213153 | A1 * | 9/2006 | Sanfilippo | B65B 31/045 53/511 |
| 2007/0003892 | A1 * | 1/2007 | Huang | F23D 14/28 431/24 |
| 2010/0015560 | A1 | 1/2010 | Kasprzyk et al. | |
| 2011/0045423 | A1 | 2/2011 | Young et al. | |

FOREIGN PATENT DOCUMENTS

| | | |
|---|---|---|
| FR | 2784173 | 4/2000 |
| GB | 207311 | 11/1923 |
| GB | 845676 | 8/1960 |
| GB | 847676 | 9/1960 |
| GB | 956326 | 4/1964 |
| GB | 984188 | 2/1965 |
| GB | 1224978 | 3/1971 |

OTHER PUBLICATIONS

"Q345A1008/U," p. 8, printed Mar. 25, 2013. http://customer.honeywell.com/en-US/Pages?Product.aspx?cat=HonECCCatalog&pid=Q345A1008/U&category=Q345&catpath=1.2.1.16#.

"Q348A1002/B," 1 page, printed Mar. 25, 2013.

"SIT Accessories," 35 pages, Downloaded Aug. 3, 2012.

U.S. Appl. No. 13/525,180 dated Jun. 15, 2012.

Honeywell, "Q179A,B Gas Pilot Burner Assemblies," 8 pages, © 2011.

Katherine M. Devries Smith, "Description of Honeywell Q5000 Water Heater Pilot Hardware," 10 pages, at least as early as Jul. 16, 2007.

Whirpool, "Whirpool Burner Pilot Assembly 74010141," 3 pages, Downloaded Mar. 25, 2013.

* cited by examiner

GAS PILOT BURNER ASSEMBLY

TECHNICAL FIELD

The present disclosure relates generally to gas-fired burner assemblies, and more particularly, to pilot burner assemblies for gas-fired appliances.

BACKGROUND

Gas-fired appliances that cycle on and off often have a pilot burner that provides a flame whose purpose is to light the main burner of the appliance when there is a call for heat. In some cases, pilot burners can also provide a safety control mechanism to help ensure that if the pilot flame is extinguished for any reason, then the supply of gas to the whole appliance is cut off.

Pilot burners for gas-fired appliances often include a pilot burner tube which defines a flame opening at one end, a thermo-electric device for detecting flame, and a spark source. The relative alignment and/or positioning of the various components of a pilot burner can affect the operation and/or reliability of the pilot burner assembly. A bracket may help maintain the alignment of the various components. However, in many cases, different appliances require different bracket configurations. Thus, in order to build or service different appliances, multiple bracket configurations must often be carried in inventory, which can be undesirable.

SUMMARY

The present disclosure relates generally to gas-fired burner assemblies, and more particularly, to pilot burner assemblies for gas-fired appliances. In one example, a field configurable burner tube assembly for a pilot burner is provided. The assembly may include a burner tube, a pilot hood, a thermo-electric device, and a bracket for carrying the pilot hood and burner tube assembly adjacent to the thermoelectric device. The pilot hood may engage the burner tube and may be secured to the burner tube in any of two or more different orientations in the field.

In some instances, a field configurable burner tube assembly for a pilot burner may include a pilot hood having a first end and a second end, and a burner tube having a first end and a second end. The second end of the burner tube may define a lumen for receiving the second end of the pilot hood. In some cases, the assembly may further include a collar and a securing element for adjustably securing the first end of the pilot hood relative to the second end of the burner tube in any of two or more different orientations in the field.

Methods of configuring a burner tube assembly in the field are also provided. In one example, a method may include adjusting an orientation of a pilot hood relative to a burner tube among two or more different orientations, and frictionally engaging the pilot hood to the burner tube in the adjusted orientation.

In some cases, a pilot burner assembly may include a first mounting bracket and a second mounting bracket. The first mounting bracket may include a first aperture for mounting a burner tube assembly and a second aperture for mounting a thermoelectric device adjacent the burner tube assembly. The first mounting bracket may include two or more mounting features for mounting the bracket to a gas fired appliance. The second mounting bracket may include two or more first mounting features configured to align with two or more of the mounting features of the first bracket to optionally mount the second mounting bracket to the first mounting bracket, and one or more second mounting features for mounting the second mounting bracket to a gas fired appliance when the first bracket is mounted the second mounting bracket. In this way, for some gas fired appliance configurations, only the first mounting bracket may be used to mount the burner tube assembly and the thermoelectric device to the gas fired appliance. For other gas fires appliance configuration, both the first mounting bracket and the second mounting bracket may be used mount the burner tube assembly and the thermoelectric device to the gas fired appliance.

BRIEF DESCRIPTION OF THE DRAWINGS

The disclosure may be more completely understood in consideration of the following description of various examples in connection with the accompanying drawings, in which.

Figure 1:
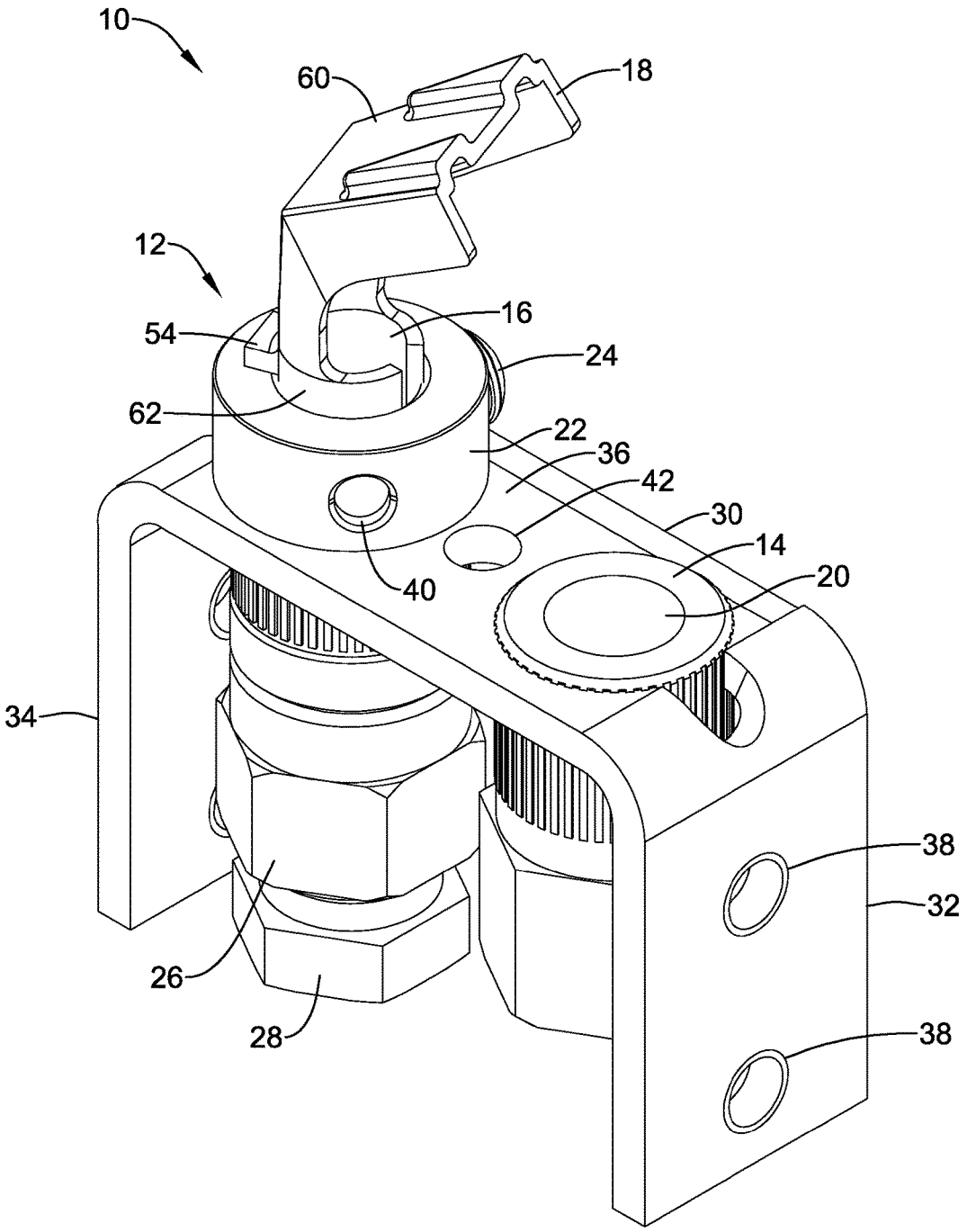
FIG. 1 is a perspective view of an illustrative pilot burner assembly.

While the disclosure is amenable to various modifications and alternative forms, specifics thereof have been shown by way of example in the drawings and will be described in detail. It should be understood, however, that the intention is not to limit aspects of the disclosure to the particular examples described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several examples which are meant to be illustrative in nature.

Pilot burners for gas-fired appliances often include a pilot burner tube which defines a flame opening at one end, a thermo-electric device for detecting flame, and a spark source. The relative alignment and/or positioning of the various components of a pilot burner can affect the operation and/or reliability of the pilot burner assembly. A bracket is often used to help maintain the alignment of the various components. In many cases, however, different appliances require different bracket configurations. Thus, in order to build or service different appliances, multiple bracket configurations must often be carried in inventory, which can be undesirable.

An illustrative burner tube assembly, such as described herein, may allow the burner tube assembly to be configured between two or more different orientations in the field, which may allow a contractor to service different appliances with a single, universal, burner tube assembly.

FIG. 1 is a perspective view of an illustrative field configurable pilot burner assembly 10 including a multiple component burner tube assembly. In FIG. 1, the illustrative assembly 10 includes a burner tube assembly 12 and a thermo-electric sleeve 14 for receiving a thermo-electric device. While not explicitly shown, in some embodiments, the pilot burner assembly 10 may also include a spark source. The burner tube assembly 12 defines a flame opening 16 at a first end, and a connection to a gas supply (e.g. to an output of a gas valve) at a second opposing end. In the example shown, the first end of the burner tube assembly 12 includes a pilot hood 18 for directing the flame towards a thermo-electric device. The burner tube assembly 12 may further include a burner tube 26 that has a compression fitting 28 or the like for connecting the burner tube assembly 12 to a gas source (not shown). As will be discussed in more detail below, the pilot hood 18 may be movably secured to the burner tube 26, sometimes using a collar 22 and a retaining member 24. This may allow the orientation of the pilot hood 18 to be adjusted in the field, which may allow a contractor to service various types of gas fired appliances using a single, universal, burner tube assembly.

While not explicitly shown, a thermo-electric device may be slidably disposed within a lumen 20 of the sleeve 14. In some embodiments, the thermo-electric device may be fixedly secured relative to the sleeve 14 while in other embodiments, the thermo-electric device may be releasably secured relative to the sleeve 14. It is contemplated that the thermo-electric device may be any suitable thermoelectric device, including a thermocouple or thermopile, as desired. A thermopile is a device that converts thermal energy into electrical energy. It is typically composed of thermocouples either connected in series or in parallel. For the pilot burner 10, it is possible for a single thermocouple to be used instead of a thermopile, but it is more common for a collection of thermocouples such as a thermopile to be used with a pilot burner. When a flame is present at the flame opening 16 of the burner tube assembly 12, the flame or heat from the flame is directed towards the body of the thermo-electric device, sometimes with the aid of pilot hood 18. In response, the thermo-electric device generates a current. The gas valve may turn off the gas to the pilot burner assembly 10 (and the main burner of the appliance) if the current from the thermo-electric device falls below a threshold, indicating a lack of a pilot flame in pilot burner assembly 10. In this way, the pilot burner 10 may provide an interlock safety mechanism for the flow of gas to a gas fired appliance. In some cases, the thermoelectric device may be a photo-electric device, which may generate a current based on light emitted from the pilot flame, rather than heat. In some cases, the thermo-electric device may function as both a sensor and a spark source for igniting the burner tube assembly 12, if desired.

In the example if FIG. 1, the burner tube assembly 12 is positioned generally parallel to the thermo-electric sleeve, although this is not required. This assembly orientation and spacing may be maintained using a mounting bracket 30. Also, the burner tube assembly 12 may be secured to a gas fired appliance (not shown) via the mounting bracket 30. The bracket 30 may be formed from stamped metal, if desired. When so provided, certain features such as first aperture 50 and second aperture 52 (see FIG. 3), may be formed when the bracket is "blanked". If certain features "float" during the stamping operation, such as first and second apertures, they will tend to float together and their positions may remain relatively fixed with respect to each other. This may help maintain the functional tolerances of the pilot burner components. Although not required, the bracket 30 may be generally "U" shaped, and may include retention features on the connecting plate 36 of the U-channel for maintaining the burner tube assembly 12 and thermo-electric sleeve 14 in a desired orientation and spacing. In some cases, this may provide tighter tolerances on the functional dimensions, without requiring adjustment or complicated fixtures in the factory or in the field.

Figure 2:
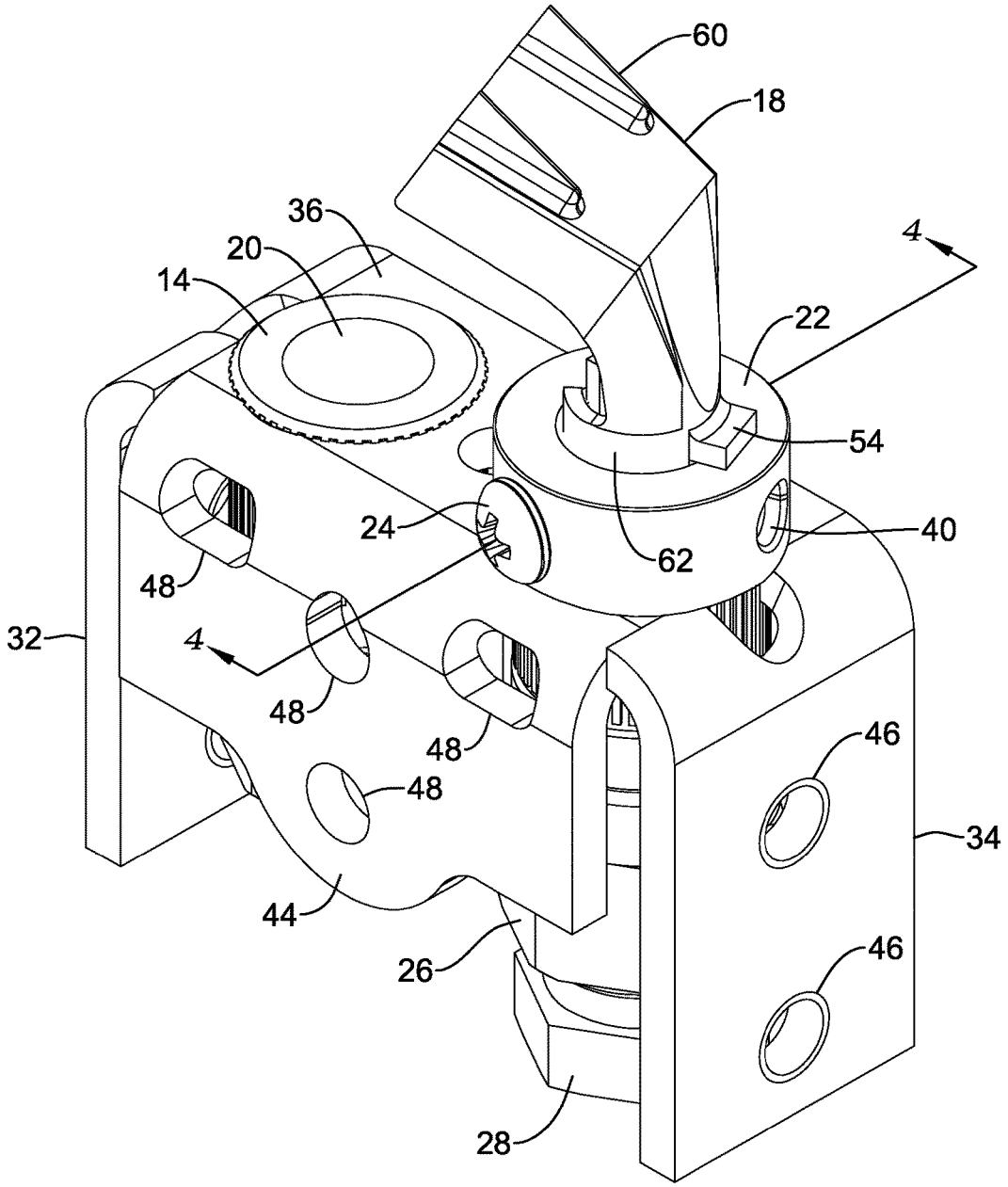
FIG. 2 is alternative perspective view of the illustrative pilot burner assembly of FIG. 1.

In the example shown in FIGS. 1-5, the bracket 30 may be formed having four plates 32, 34, 36, and 44. The first plate 32 and second plate 34 may be spaced a distance from one another and extend approximately parallel to one another, although this is not required. The first and second plates 32, 34 may be connected by a third plate 36. The third plate 36 may be positioned generally orthogonal to the first and second plates 32, 34, although this is not required. As best shown in FIG. 2, the fourth plate 44 may be positioned between the first and second plates 32, 34 and may extend generally orthogonally from the third plate 36. The first plate 32, the second plate 34, and the third plate 36, may form a general "U channel" shape. As discussed above, the bracket 30 may be formed as a unitary piece stamped metal. The stamped metal may be subsequently bent or otherwise manipulated to form the bracket 30. It is further contemplated that in some instances, the four plates 32, 34, 36, 44 may be formed as separate components and subsequently connected to one another, if desired.

The first plate 32 may include a first set of one or more mounting features 38. It is contemplated that in some instances, the mounting features 38 may be apertures for receiving a screw or other retaining mechanism. In other instances, the mounting features 38 may include a hook or other device configured to engage a mating feature adjacent to or on a gas fired appliance. The mounting features 38 may be configured to secure the bracket 30 to a burner of a gas fired appliance. It is contemplated that second plate 34 may include a second set of one or more mounting features 46, and the fourth plate 44 may include a third set of one or more mounting features 48, each configured to secure the bracket 30 adjacent to a burner of a gas fired appliance. It is contemplated that any one or a combination of any of the sets of mounting features 38, 46, 48 may be used to secure the bracket 30 to a gas fired appliance, depending on the particular configuration of the gas fired appliance being serviced.

Figure 3:
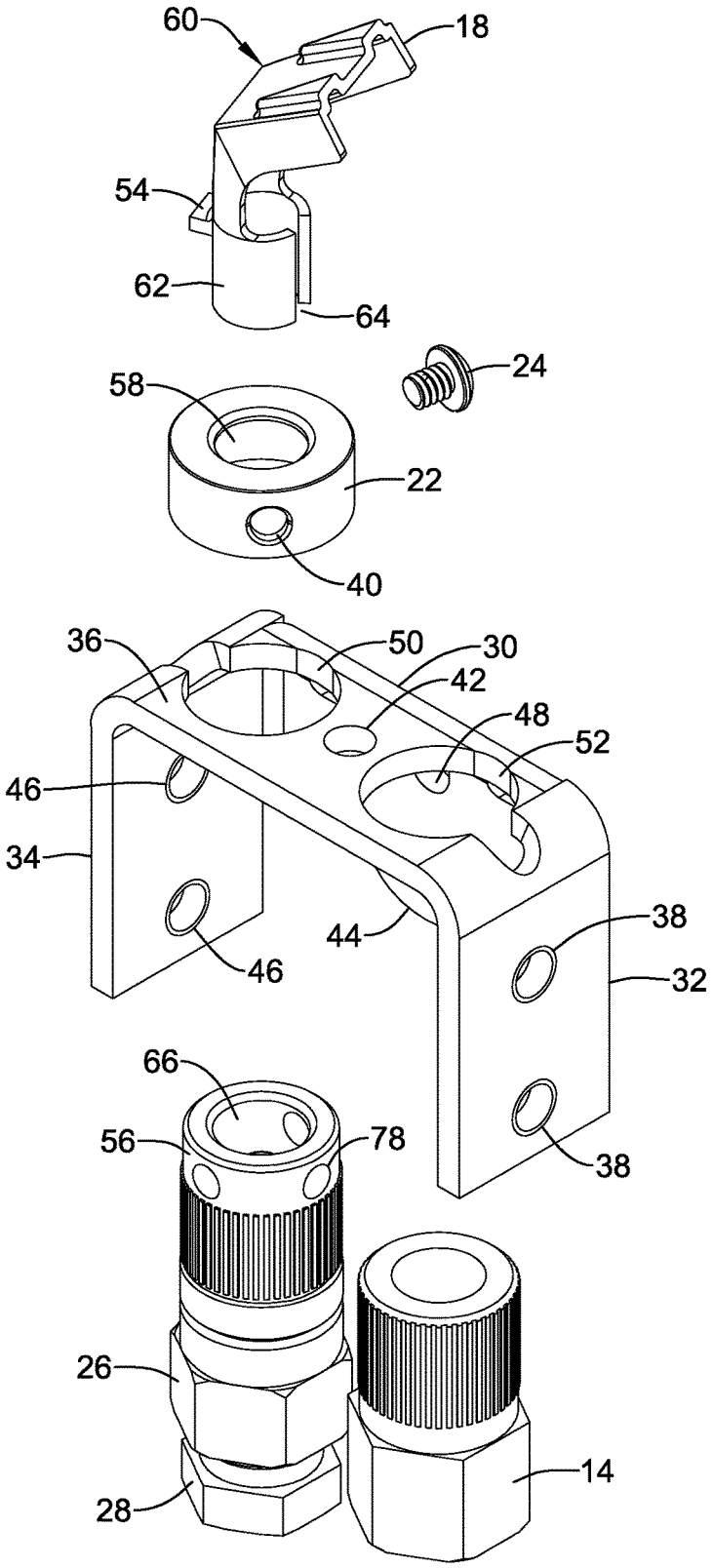
FIG. 3 is an exploded perspective view of the illustrative pilot burner assembly of FIG. 1.
Figure 5:
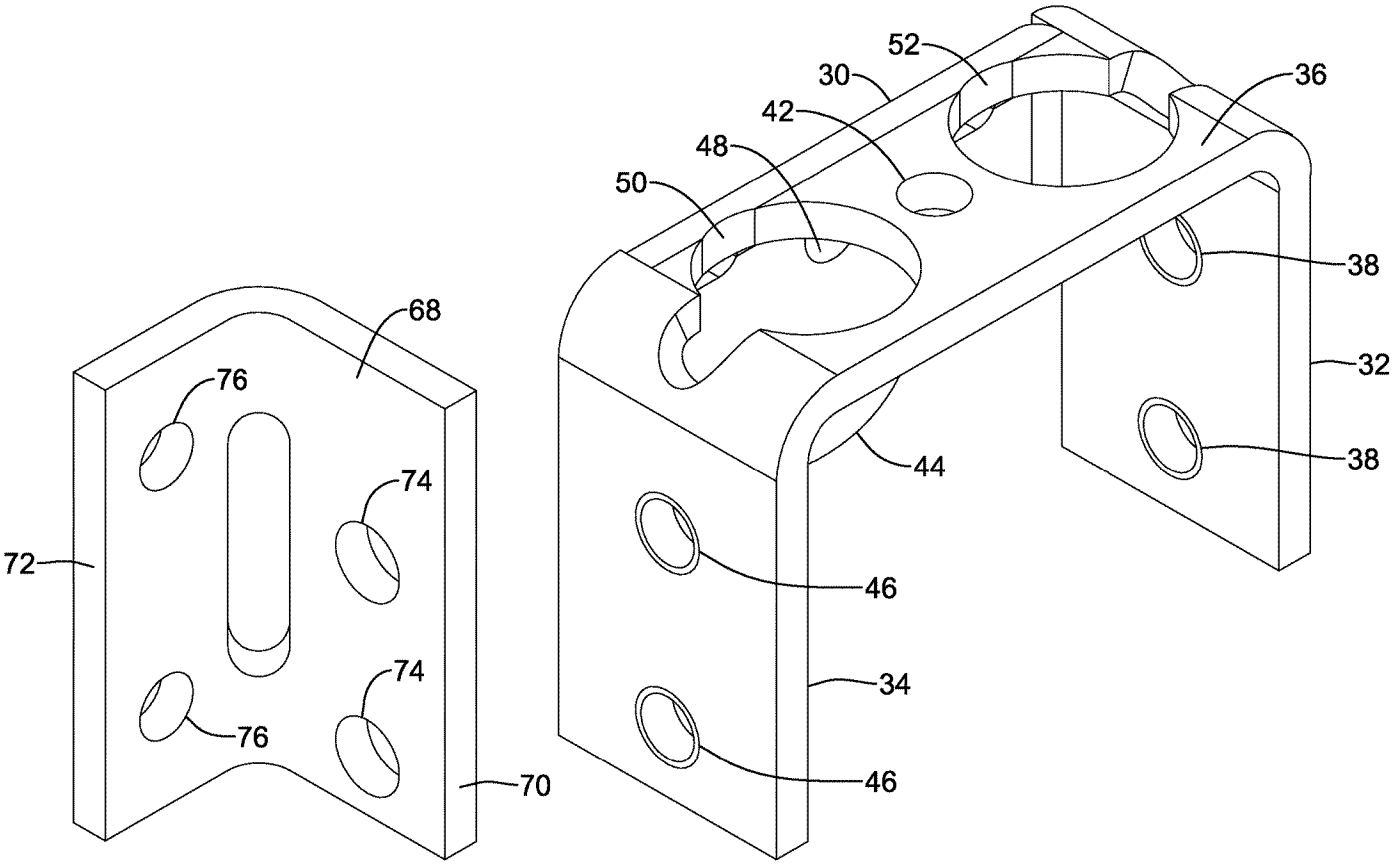
FIG. 5 is a perspective view of an illustrative pilot burner mounting bracket.

The third or connecting plate 36 may include a first aperture 50, as best seen in FIGS. 3 and 5, for receiving the burner tube assembly 12, and a second aperture 52 for receiving the thermo-electric sleeve 14. However, it is contemplated that the burner tube assembly 12 and the thermo-electric sleeve 14 may be received in either aperture 50, 52, or another aperture, as desired. In some instances, the third plate 36 may include an additional aperture 42 for receiving additional components or retaining mechanisms, such as a spark source.

Although not required, the burner tube assembly 12 may be formed of multiple components, such as a pilot hood 18, a collar 22, a burner tube 26, and a compression fitting 28. The pilot hood 18 may include a first hood portion 60 and a second tubular portion 62 extending away from the first hood portion 60. The pilot hood 18 may be movably secured to the burner tube 26. In some instances, the collar 22 and a retaining member 24 may help secure the pilot hood 18 to the burner tube 26 as well as secure the burner tube assembly 12 to the bracket 30. In the example shown, the collar 22 may have a generally tubular structure extending from a first end (toward the top is FIG. 3) to a second end (toward the bottom in FIG. 3). A central lumen 58 may extend between the first end and second end, and may have a smaller diameter adjacent the first end than the diameter adjacent the second end due to a perpendicularly extending rim at the first end. The central lumen 58 may extend from the top surface to the bottom surface. One or more apertures 40 may extend from an outer side surface into the central lumen 58. To assemble the burner tube assembly 12 with the bracket 30, the burner tube 26 may be advanced through aperture 50 in the bracket 30 such that a first end 56 of the burner tube 26 extends through the aperture 50. In some instances, the burner tube 26 may include grooves or ridges configured to frictionally engage the side walls defining the aperture 50. Once the burner tube 26 is positioned, collar 22 may be disposed over the first end 56 of the burner tube 26 such that the first end 56 is disposed within a lumen 58 of the collar 22. As discussed above, the diameter of the collar 22 at the second end may be larger than an outer diameter of the first end 56 of the burner tube 26 such that the collar 22 surrounds the burner tube 26. In some instances, the smaller diameter of the lumen 58 of collar 22 at the first end thereof may be configured such that the rim engages a top surface of the burner tube, although this is not required.

Figure 4:
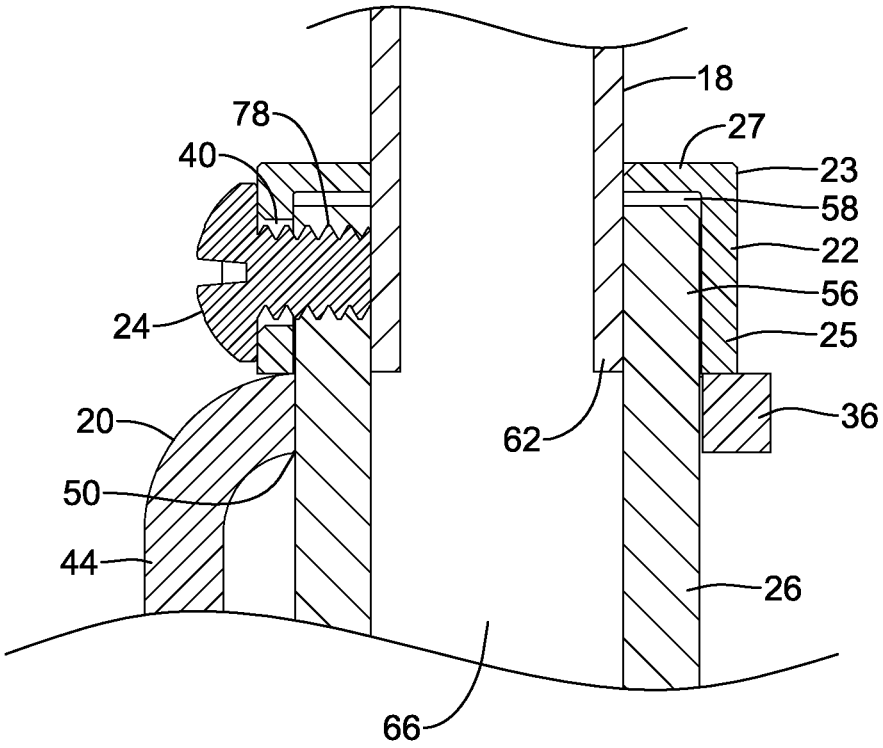
FIG. 4 is a partial cross-sectional view of the illustrative burner tube assembly of FIG. 2, taken along line 4-4.

FIG. 4 illustrates a partial cross-section of the burner tube assembly 12 taken at line 4-4 in FIG. 2. As discussed above, the collar 22 may have a generally tubular structure extending from a first end 23 to a second end 25. A central lumen 58 may extend between the first end 23 and second end 25, and may have a smaller diameter adjacent the first end 23 than the diameter adjacent the second end 25 due to the perpendicularly extending rim 27 at the first end. As can be seen in FIG. 4, the first end 56 of the burner tube 26 extends through the aperture 50 in the bracket 20. The collar 22 may be disposed over first end 56 of the burner tube 26 such that the collar 22 surrounds the burner tube 26. In some instances, the second end 25 of the collar 22 may engage the connecting plate 36 of the bracket 20. This may help prevent the collar 22 from passing through aperture 50. The tubular portion 62 of the pilot hood 18 may be positioned within the lumen 58 of the collar 22, and in some cases, a lumen 66 of the burner tube 26. In some instances, the diameter of the tubular portion 62 of the pilot hood 18 may be similar in size to the lumens 58 and/or 66 of the collar 22 and the burner tube 26, so that the tubular portion 62 is frictionally engaged by the collar 22 and/or the burner tube 26. The collar 22 may be positioned such that aperture(s) 40 generally aligns with aperture(s) 78. In some instances, during the manufacturing processes, apertures 40 in the collar 22 and apertures 78 in the burner tube 26 may be formed simultaneously. For example, during manufacture, the collar 22 may be disposed over the burner tube 26 and apertures 40, 78 may be formed simultaneously such that the apertures 40 in the collar 22 and the apertures 78 in the burner tube 78 generally align. A set screw, or other retaining element, 24 may be advanced through the apertures 40, 78 until it frictionally engages an outer surface of the pilot hood 18 to maintain the pilot hood 18 in a desired orientation. In some instances, the tubular portion 62 of the pilot hood 18 may include a slot or recess 64, as shown in FIG. 3. This may allow the tubular portion 62 to more readily compress as it is advanced into the collar 22 and/or burner tube 26, thus providing a snug friction fit or press fit to secure the pilot hood 18. It is contemplated that the pilot hood 18 may be assembled with the collar 22 prior to placing the collar 22 over the burner tube 26, but this is not required. For example, in some instances, the pilot hood 18 may be brazed or otherwise attached to the collar 22.

In some instances, the pilot hood 18 may include a tab or protrusion 54, as shown in FIG. 2, extending from the tubular portion 62. The tab 54 may be configured to engage the collar 22 to prevent the pilot hood 18 from being advanced too far within the collar 22 and/or burner tube 26. This may help maintain the vertical alignment of the pilot hood 18. Once the pilot hood 18 has been positioned within the collar 22, the pilot hood 18 may be rotated such that the flame is directed towards a desired location, as will be discussed in more detail below with respect to FIGS. 6A and 6B. It is further contemplated that the pilot hood 18 may be positioned within the collar 22 and/or burner tube 26 at the desired orientation.

In some instances, the pilot hood 18, collar 22, and burner tube 26 may be secured to one another using a set screw 24 and/or other retaining element. In the example shown, it is contemplated that the set screw 24 may be threadably secured within an aperture 40 in the collar 22. The aperture 40 may extend through a side wall of the collar 22 as shown. In some instances, the burner tube 26 may include apertures 78 extending through a side surface and into the lumen 66 of the burner tube 26. The apertures 78 may be configured to generally align with the apertures in the collar 22. When so provided, the set screw 24 may pass through the aperture 40 in the collar 22, through the aperture 78 in the burner tube 26, and come into contact with the tubular portion 62 of the pilot hood 18. It is contemplated that the collar 22 may include one or more apertures 40 that may facilitate securing the pilot hood 18 in a variety of orientations. It is contemplated that if the pilot hood 18 needs to be repositioned, one may loosen and/or remove the set screw 24, rotate the pilot hood 18 to the desired position, and tighten and/or reinstall the set screw 24. While the retaining member 24 has been described as a set screw, it is contemplated that other retaining mechanisms may be used such as a bolt, pin or any other suitable retaining element as desired.

Turning now to FIG. 5, in some embodiments, the bracket 30 may include an auxiliary bracket 68. The auxiliary bracket 68 may be formed from stamped metal, if desired. When so provided, certain features such as retaining features, or apertures, 74 and retaining features, or apertures, 76 may be formed when the bracket is "blanked". If certain features "float" during the stamping operation, such as apertures 74, 76, they will tend to float together and their positions may remain relatively fixed with respect to each other. In the example shown, the bracket 68 may be generally "L" shaped. The auxiliary bracket 68 may include a first plate 70 and a second plate 72 positioned approximately perpendicular to one another. The first plate 70 may include a first set of one or more retaining features 74 (e.g. apertures). The apertures 74 may be configured to generally align with the first or second set of apertures 38, 46 on the first or second plate 32, 34 of bracket 30. It is contemplated that when so desired, the auxiliary bracket 68 may be secured to bracket 30 by aligning apertures 74 with either apertures 38 or apertures 46 and affixing retaining elements, such as screws or bolts and nuts, through the apertures. The second plate 72 may include a second set of one or more retaining features or apertures 76. Apertures 76 may be configured to receive retaining elements for securing the brackets 30, 68 to a burner. In some instances, the retaining elements may be screws, bolts, hooks, etc. For some gas fired appliance configurations, only bracket 30 may be used to mount the burner tube assembly and the thermoelectric device to the gas fired appliance. For other gas fires appliance configuration, the auxiliary bracket 68 may be mounted to the mounting bracket 30, and both the mounting 30 and the auxiliary bracket 68 may be used mount the burner tube assembly and the thermoelectric device to the gas fired appliance.

Figure 6A:
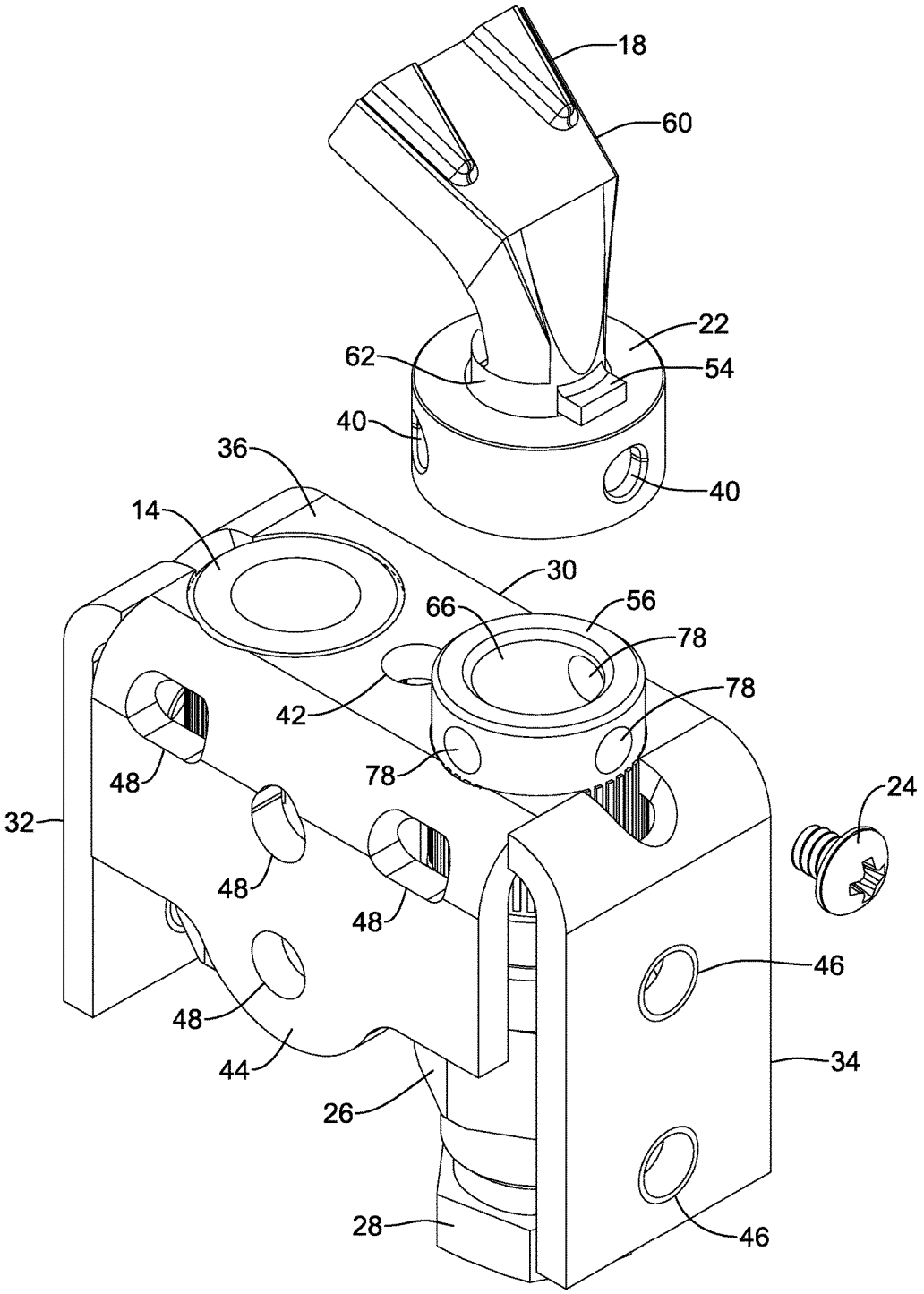
FIG. 6A is a partially exploded perspective view of an illustrative pilot burner assembly.
Figure 6B:
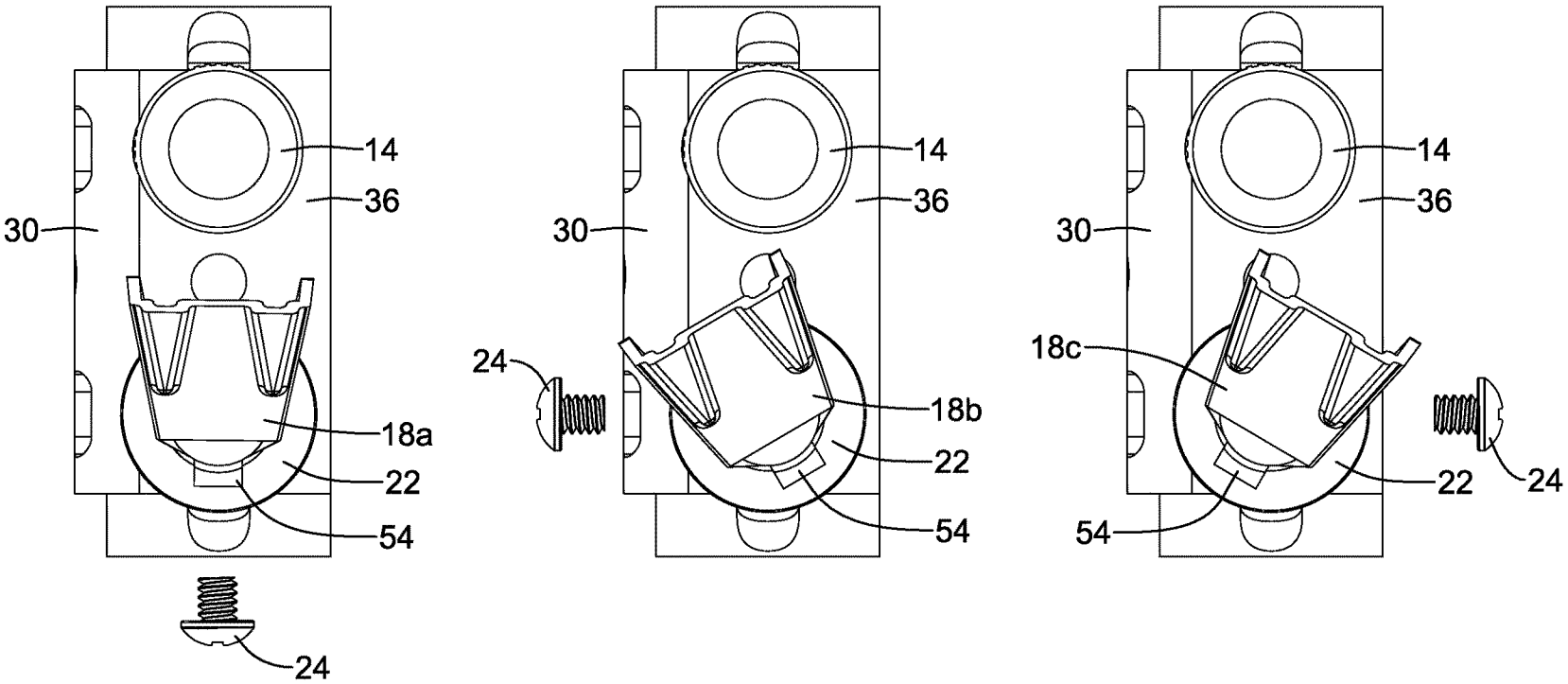
FIG. 6B is a top view of an illustrative pilot burner assembly with the pilot hood of the pilot burner tube in different configurations.

Turning now to FIGS. 6A and 6B, the illustrative adjustable pilot hood 18 is discussed in more detail. As discussed above, the pilot hood 18 may be removable and/or rotatable relative to the burner tube 26, thus allowing the pilot hood 18 orientation to be changed to a desired configuration in the field. In some instances, the tubular portion 62 of the pilot hood 18 may be disposed within the lumen 58 of the collar 22. The tubular portion 62 of the pilot hood 18 may also be disposed within the lumen 66 of the burner tube 26, while the collar 22 is disposed around an outer surface of the burner tube 26 (see FIG. 4). Alternatively, the collar 22 may be disposed around the burner tube 26 and the pilot hood 18 may be subsequently assembled into the collar 22 and the burner tube 26. As noted above, the pilot hood 18 may include a tab 54 which may engage the collar 22 to prevent further advancement of the pilot hood 18 into the collar 22/burner tube 26.

Apertures 40 in the collar 22 may generally align with apertures 78 in the burner tube 26. Once the pilot hood 18 is disposed within the burner tube 26, the pilot hood 18 may be rotated to a desired orientation. A set screw 24 may then be secured within aperture 40 and aperture 78 to retain the pilot hood 18 in the desired configuration. The set screw 24 may extend through the collar 22 and the burner tube 26, and may contact an outer surface of the tubular portion 62 of the pilot hood 18 to hold the pilot hood 18 in the desired position. While there are three apertures 40, 78 illustrated in each of the collar 22 and the burner tube 26, the orientation of the pilot hood 18 may not be limited by which aperture the set screw 24 engages. As the tubular portion 62 of the pilot hood 18 does not include apertures, the set screw 24 may frictionally engage the outer surface of the tubular portion 62 to retain it in any orientation desired. If it is desired to reposition the pilot hood 18, the set screw 24 may be loosed and/or removed, and the pilot hood 18 may be repositioned. In some instances, the diameter of the tubular portion 62 of the pilot hood 18 may be similar in size or slightly larger than the diameter of the lumen 66 of burner tube 26. This may result in a friction or press fit between the tubular portion 62 of the pilot hood 18 and the burner tube 26, which may also help secure the pilot hood 18. In other instances, the diameter of the tubular portion 62 of the pilot hood 18 may be smaller than the diameter of the lumen 66 of the burner tube 26.

As shown in FIG. 6B, it is contemplated that the pilot hood 18 may be positioned such that it faces front 18A, left 18B, and right 18C. These positions are just examples. While the pilot hood 18 is illustrated as being positioned in three discrete positions, it is contemplated that in some instances the pilot hood 18 may be positioned at any orientation desired (i.e. infinitely adjustable). In some instances, the set screw 24 may be secured to a different location of the collar 22 and burner tube 26. This may allow the installer to select the aperture 40 that is most readily accessible in the particular installation in the field to secure the pilot hood assembly 18. In the illustrative embodiment, the collar 22 and burner tube 26 may include three apertures 40, 78.

In some instances, the apertures 40, 78 may be formed to allow the pilot hood 18 to be placed in a predetermined orientation. For example, the pilot hood 18 may be fixedly secured to the collar 22 during the manufacturing process. During manufacture, the pilot hood 18 and collar 22 assembly may be disposed over the burner tube 26 and apertures 40, 78 may be formed simultaneously such that the apertures 40 in the collar 22 and the apertures 78 in the burner tube 78 generally align. Apertures 40, 78 may be formed such that when the pilot hood 18 and the collar 22 are secured to the burner tube 26, the pilot hood 18 may be oriented in a predetermined number of orientations. In some embodiments, the pilot hood 18 may be secured such that it generally faces the thermocouple or is offset by approximately 20° in either direction relative to the thermocouple. This is just an example. The predetermined orientations may be any angle desired.

Figure 7:
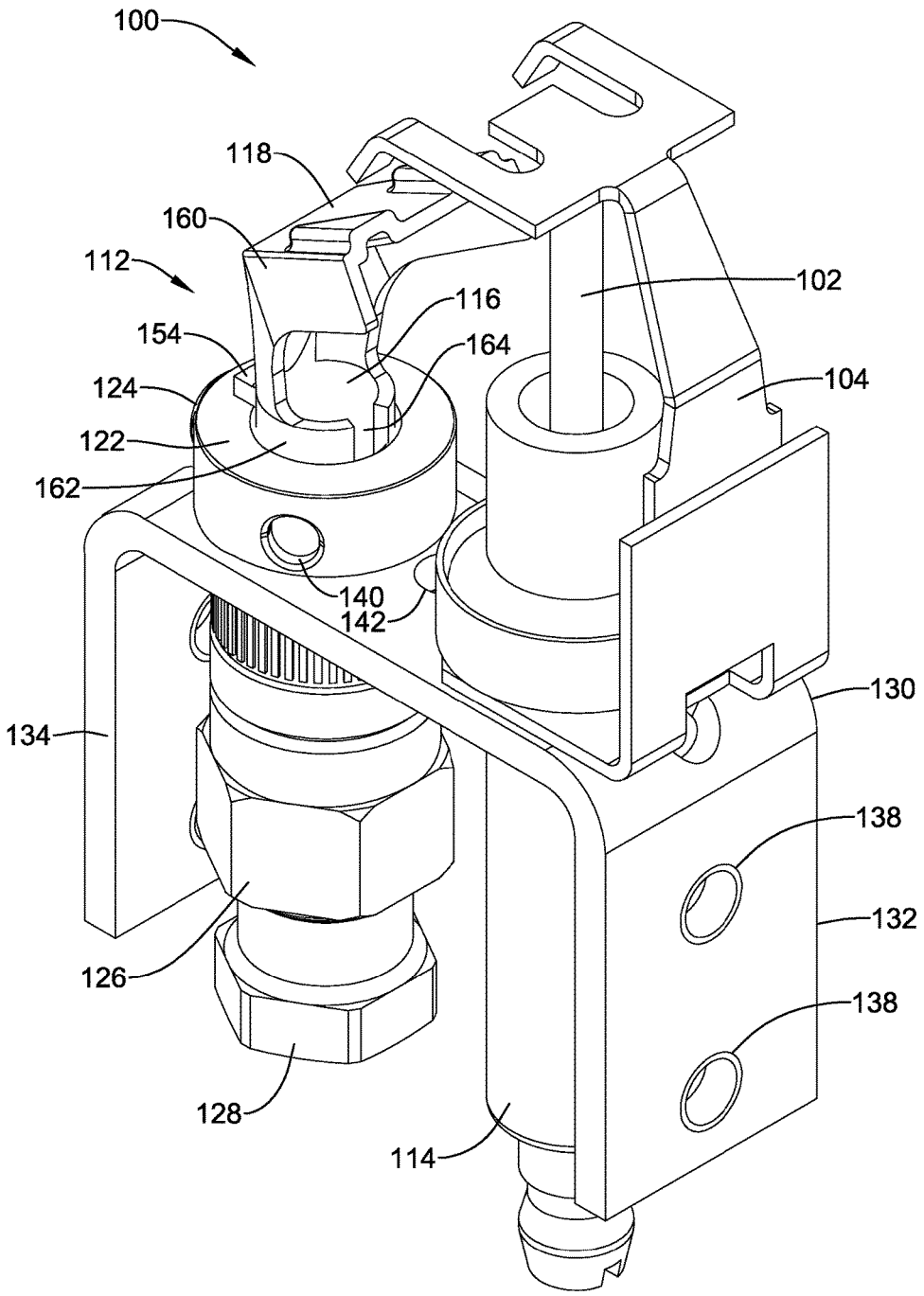
FIG. 7 is a perspective view of another illustrative pilot burner assembly.

FIG. 7 is a perspective view of another illustrative pilot burner assembly 100 including a multiple component burner tube assembly. Pilot burner assembly 100 may be similar in form and function to the pilot burner assembly 10 discussed above. In FIG. 7, the illustrative pilot burner assembly 100 includes a burner tube assembly 112 and a thermo-electric device sleeve 114 for receiving a thermo-electric device 102. While not explicitly shown, in some embodiments, the pilot burner assembly may also include a spark source. The burner tube assembly 112 defines a flame opening 116 at a first end, and a connection to a gas supply (e.g. to an output of a gas valve) at a second opposing end. In the illustrative example shown, the first end of the burner tube assembly 112 includes a pilot hood 118 for directing the flame towards the thermo-electric device 102. The burner tube assembly 112 may further include a burner tube 126 for receiving an orifice (not explicitly shown) and a compression fitting 128 for connecting the burner tube assembly 112 to a gas source. It is contemplated that the pilot hood 118, collar 122, set screw 124, and burner tube 126 may the same as the pilot hood 18, collar 22, set screw 24, and burner tube 26 described above, illustrating that a single burner tube assembly may be used in multiple pilot burner assemblies. As will be discussed in more detail below, the pilot hood 118 may be movably secured to the burner tube 126, sometimes using a collar 122 and a retaining member 124. This may allow the orientation of the pilot hood 118 to be adjusted in the field depending on the particular application at hand.

In some embodiments, the thermo-electric device 102 may be slidably disposed within a lumen of the thermo-electric device sleeve 114. In other embodiments, the thermo-electric device 102 may be fixedly secured relative to the thermo-electric device sleeve 114, while in other embodiments, the thermo-electric device 102 may be releasably secured relative to the thermo-electric device sleeve 114. It is contemplated that the thermo-electric device 102 may be any suitable thermoelectric device including a thermocouple or thermopile, as desired. In some embodiments, the thermo-electric device 102 may further include a ground strap 104. The ground strap 104 may be secured between a bracket 130 and the thermo-electric device sleeve 114.

In the example show, the burner tube assembly 112 is positioned generally parallel to the thermo-electric device 102, although this is not required. This assembly orientation and spacing may be maintained using a mounting bracket 130. The bracket 130 may be formed from stamped metal, if desired. When so provided, certain features such as apertures (not explicitly shown) for receiving the burner tube assembly 112 and the thermo-electric device sleeve 114, may be formed when the bracket is "blanked". If certain features "float" during the stamping operation, such as the aforementioned apertures, they will tend to float together and their positions may remain relatively fixed with respect to each other. This may help maintain the functional tolerances of the pilot burner components, when required. In the illustrative embodiment, the bracket 130 may be generally "U" shaped, and may include retention features on the connecting plate 136 of the U-channel for maintaining the burner tube assembly 112 and thermo-electric device sleeve 114 in a desired orientation. This may allow tighter tolerances on the functional dimensions, without requiring adjustment or complicated fixtures in the factory or in the field. While not explicitly shown, the bracket 130 may include an auxiliary bracket similar in form and function to auxiliary bracket 68 discussed above.

In the example shown, the bracket 130 may be formed having four plates. While only three plates are visible in FIG. 7, the fourth plate may be similar in form and function to plate 44 discussed above. The first plate 132 and second plate 134 may be spaced a distance from one another and extend approximately parallel to one another, although this is not required. The first and second plates 132, 134 may be connected by a third plate 136. The third plate 136 may be positioned generally orthogonal to the first and second plates 132, 134, although this is not required. The first plate 132, the second plate 134, and the third plate 136, may form a general "U channel" shape as shown. As discussed above, the bracket 130 may be formed as a unitary piece stamped metal. The stamped metal may be subsequently bent or otherwise manipulated to form the bracket 130. It is further contemplated that in some instances, the plates 132, 134, 136 may be formed as separate components and subsequently connected to one another.

The first plate 132 may include a first set of one or more mounting features 138. It is contemplated that in some instances, the mounting features 138 may be apertures for receiving a screw or other retaining mechanism. In other instances, the mounting features 138 may include a hook or other feature configured to engage a mating feature adjacent or on a gas fired appliance. The mounting features 138 may be configured to secure the bracket 130 adjacent to a burner. In some cases, second plate 134 may include a second set of one or more mounting features (not explicitly shown), and the fourth plate (not explicitly shown) may include a third set of one or more mounting features, sometimes configured to receive a screw or other retaining mechanism to secure the bracket 130 adjacent to a burner. It is contemplated that any one or a combination of any of the sets of mounting features 138 may be used to secure the bracket 130, depending on the configuration of the gas fired appliance at hand.

The third or connecting plate 136 may include a first aperture (not explicitly shown) for receiving the burner tube assembly 112, and a second aperture (not explicitly shown) for receiving the thermo-electric device sleeve 114 and thermo-electric device 102. It is contemplated that the burner tube assembly 112 and the thermo-electric device sleeve 114 may be received in either aperture as desired. In some instances, the third plate 136 may further include an additional aperture 142 for receiving additional components or retaining mechanisms, as desired.

In some embodiments, the burner tube assembly 112 may be formed of multiple components including a pilot hood 118, a collar 122, a burner tube 126, and a compression fitting 128. In some instances, collar 122 may be similar in form and function to collar 22 discussed above. The pilot hood 118 may include a first hood portion 160 and a second tubular portion 162 extending away from the hood portion 160. The pilot hood 118 may be movably secured to the burner tube 126 using the collar 122 and a retaining member 124. To assemble the burner tube assembly 112 with the bracket 130, and in some instances, the burner tube 126 may be advanced through an aperture in the third plate 136 such that a first end of the burner tube 126 extends through the aperture. Once the burner tube 126 is positioned, collar 122 may be disposed over the first end of the burner tube 126 such that the first end is disposed within a lumen of the collar 122. In some cases, the collar 122 may have a larger cross-section than a cross-section of the aperture. This may help prevent the collar 122 from passing through the aperture in order to retain the burner tube 126 with respect to the bracket 130. The tubular portion 162 of the pilot hood 118 may then be positioned within the lumen of the collar 122 and/or a lumen of the burner tube 126. Alternatively, and in some cases, it is contemplated that the pilot hood 118 may be assembled with the collar 122 prior to placing the collar 122 over the burner tube 126.

In some instances, the tubular portion 162 of the pilot hood 118 may include a slot or recess 164. This may allow the tubular portion 162 to more readily compress as it is advanced into the collar 122 and/or burner tube 126, thus providing a snug friction fit or press fit to secure the pilot hood 118 in place. In some instances, the pilot hood 118 may include a tab or protrusion 154 extending from the tubular portion 162. The tab 154 may be configured to engage the collar 122 to prevent the pilot hood 118 from being further advanced within the collar 122 and burner tube 126. This may help maintain the vertical alignment of the pilot hood 118. Once the pilot hood 118 has been positioned within the collar 122 and/or burner tube 126, the pilot hood 118 may be rotated such that the flame is directed towards a desired location.

One or more apertures 140 in the collar 122 may generally align with one or more apertures in the burner tube 126. Once the pilot hood 118 is disposed within the burner tube 126, the pilot hood 118 may be rotated or otherwise moved to a desired configuration. A set screw 124 may be secured within aperture 140 and the aperture in the burner tube to retain the pilot hood 118 in the desired configuration. While there are two apertures 140 illustrated in the collar 122, the orientation of the pilot hood 118 may not be limited by which aperture the set screw engages. As the tubular portion 162 of the pilot hood 118 does not include apertures, the set screw may frictionally engage the outer surface of the tubular portion 162 to retain it in any orientation desired. The set screw 124 may extend through the collar 122 and the burner tube 126 to contact the pilot hood 118 to hold the pilot hood 118 in the desired position. If it is desired to reposition the pilot hood 118, the set screw 124 may be loosed and/or removed and the pilot hood repositioned. In some instances, the diameter of the tubular portion 162 of the pilot hood 118 may be similar in size or slightly larger than the diameter of the lumen of burner tube 126. This may result in a friction or press fit between the pilot hood 118 and the burner tube 126 to help secure the pilot hood 118. In other instances, the diameter of the tubular portion 162 of the pilot hood 118 may be smaller than the diameter of the lumen of the burner tube 126.

It is contemplated that the pilot hood 118 may be positioned such that it faces front, left, or right. These positions are just examples. While the pilot hood 118 is described as being positioned in three discrete positions, it is contemplated that in some instances the pilot hood 118 may be positioned at any orientation desired (infinitely adjustable). In some instances, the set screw 124 may be secured to a different location of the collar 122 and burner tube 126. This may allow the installer to select the aperture 40 that is most readily accessible to secure the pilot hood 18. For example, more than one aperture 140 may be provided to allow the set screw 124 to be repositioned.

Figure 8:
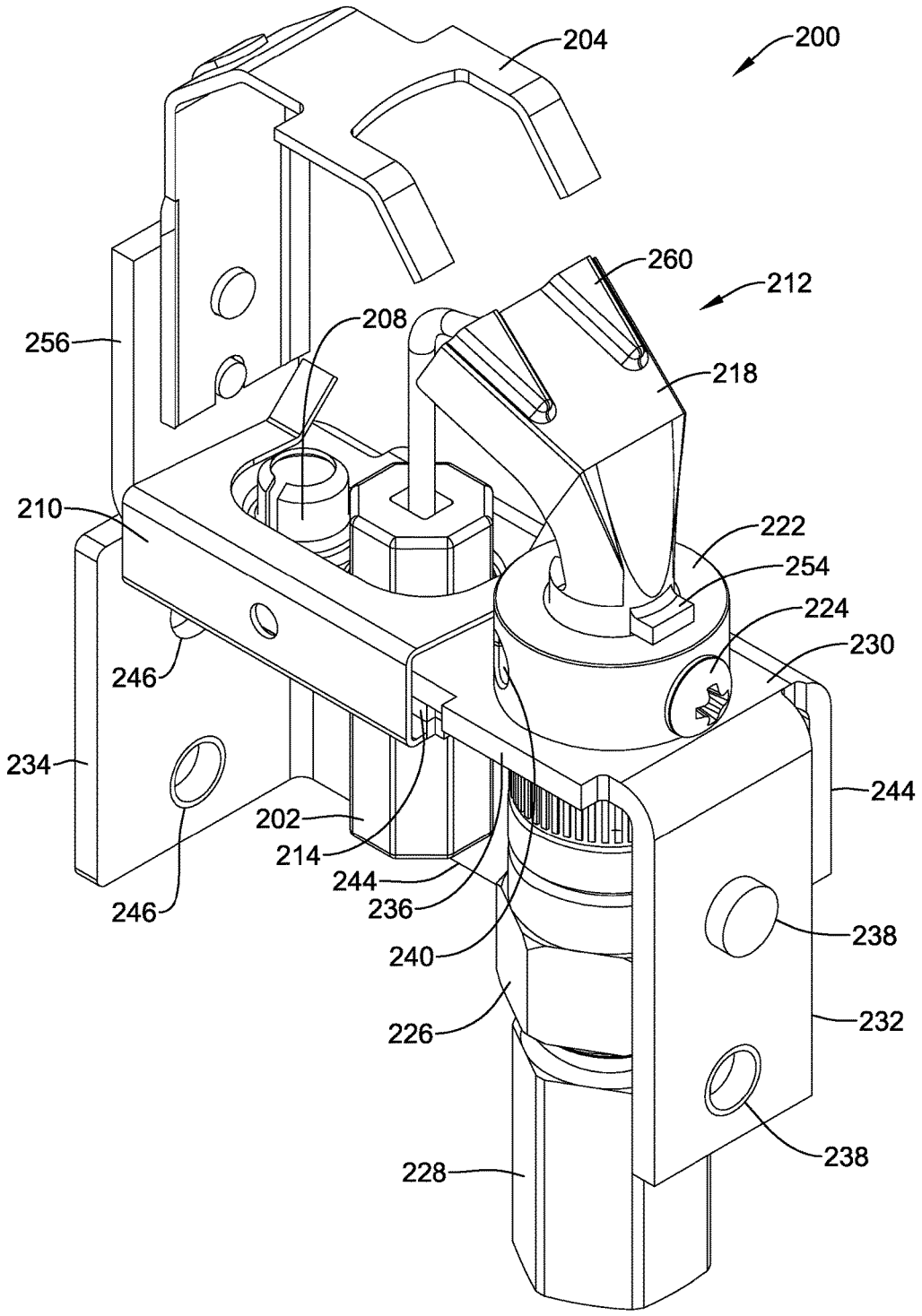
FIG. 8 is a perspective view of another illustrative pilot burner assembly.

FIG. 8 is a perspective view of another illustrative pilot burner assembly 200 including a multiple component burner tube assembly. In FIG. 7, the illustrative pilot burner assembly 200 includes a burner tube assembly 212 and a thermo-electric device 202. It is contemplated that the thermo-electric device may be any suitable thermoelectric device 202 including a thermocouple or thermopile, as desired. In some instances, the thermo-electric device 202 may function as both a sensor and a spark source for igniting the burner tube assembly 212, but this is not required. While not explicitly shown, in some embodiments, the pilot burner assembly 200 may include a separate spark source. The burner tube assembly 212 may define a flame opening (not explicitly shown) at a first end, and a connection to a gas supply (e.g. to an output of a gas valve) at a second opposing end. In the illustrative embodiment shown, the first end of the burner tube assembly 212 includes a pilot hood 218 for directing the flame towards the thermo-electric device 202. The burner tube assembly 212 may further include a compression fitting 228 for connecting the burner tube assembly 212 to a gas source. It is contemplated that pilot hood 218, collar 222, set screw 224, and burner tube 226, may be the same or similar to the pilot hood 18, 118, collar 22, 122, set screw 24,124, and burner tube 26, 126 described above, further illustrating that a single burner tube assembly may be used in multiple pilot burner assemblies. As will be discussed in more detail below, the pilot hood 218 may be movably secured to the burner tube 226, sometimes using a collar 222 and a retaining member 224. This may allow the orientation of the pilot hood 218 to be adjusted in the field based on a given application.

In the example shown, the burner tube assembly 212 may be positioned generally parallel to the thermo-electric device 202, although this is not required. This assembly orientation may be maintained using a mounting bracket 230. The bracket 230 may be formed from stamped metal, if desired. When so provided, certain features such as first aperture 250 and second aperture 252 (see FIG. 9), may be formed when the bracket is "blanked". If certain features "float" during the stamping operation, such as first and second apertures 250, 252, they will tend to float together and their positions may remain relatively fixed with respect to each other. This may help maintain the functional tolerances of the pilot burner components. In the illustrative embodiment, the bracket 230 may be provided with retention features for maintaining the burner tube assembly 212 and thermo-electric device 202 in a desired orientation. This may allow tighter tolerances on the functional dimensions to be maintained, without requiring adjustment or complicated fixtures in the factory or in the field. While not explicitly shown, the bracket 230 may include an auxiliary bracket similar in form and function to auxiliary bracket 68 discussed above.

Figure 9:
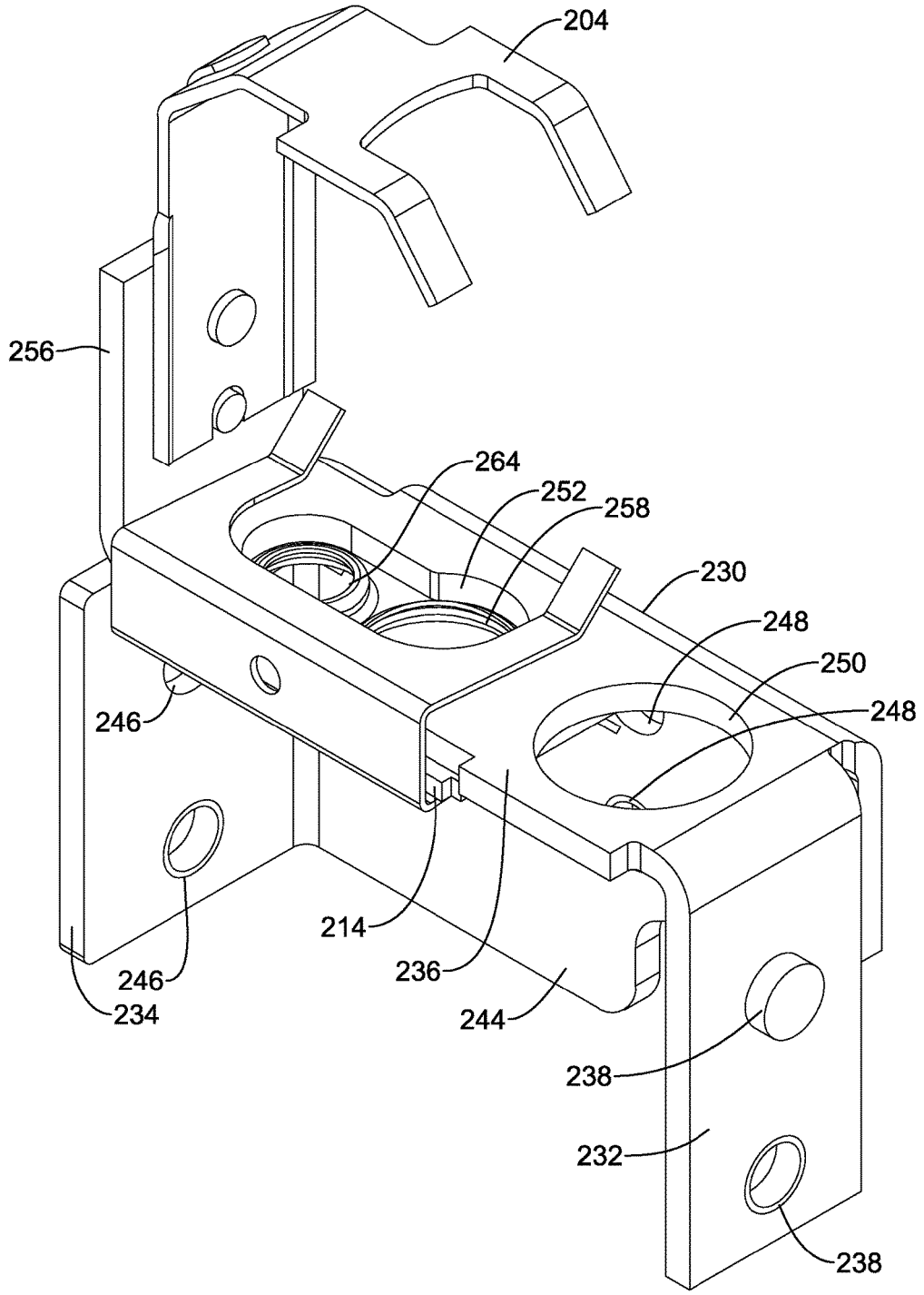
FIG. 9 is a perspective view of the illustrative pilot burner mounting bracket of FIG. 8 with some components removed.

In the illustrative embodiment, and as shown in FIGS. 8-9, the bracket 230 may be formed having five plates 232, 234, 236, 244, 256. The first plate 232 and second plate 234 may be spaced as distance from one another and extend approximately parallel to one another, although this is not required. The first and second plates 232, 234 may be connected by a third plate 236. The third plate 236 may be positioned generally orthogonal to the first and second plates 232, 234, although this is not required. The first plate 232, the second plate 234, and the third plate 236 may form a general "U channel" shape. As best shown in FIG. 9, the fourth plate 244 may be positioned between the first and second plates 232, 234 and may extend generally orthogonally from the third plate 236. The fifth plate 256 may extend orthogonally from the third plate 236 parallel to the second plate 234. The fifth plate 256 may extend from the third plate 236 in a direction generally opposite from the fourth plate 244. As discussed above, the bracket 230 may be formed as a unitary piece stamped metal. The stamped metal may be subsequently bent or otherwise manipulated to form the bracket 230. It is further contemplated that in some instances, the five plates 232, 234, 236, 244, 256 may be formed as separate components and subsequently connected to one another.

The first plate 232 may include a first set of one or more mounting features 238. It is contemplated that in some instances, the mounting features 238 may be apertures for receiving a screw or other retaining mechanism. In other instances, the mounting features 238 may include a hook or other device configured to engage a mating feature adjacent or on a gas fired appliance. The mounting features 238 may be configured to secure the bracket 230 adjacent to a burner. Similarly, second plate 234 may include a second set of one or more mounting features or apertures 246 and the fourth plate 244 may include a third set of one or more mounting features or apertures 248 configured to receive a screw or other retaining mechanism to secure the bracket 230 adjacent to a burner. It is contemplated that any one, or any combination, of the sets of mounting features apertures 238, 246, 248 may be used to secure the bracket 230, depending on the configuration of the particular gas fired appliance at hand. While not explicitly shown, the fifth plate 256 may include one or more apertures which may be used to secure a ground strap 204 to the bracket 230, if desired.

The third or connecting plate 236 may include a first aperture 250, as best seen in FIG. 8, for receiving the burner tube assembly 212, and a second aperture 252 for receiving the thermo-electric device 202 and/or other components 208. However, it is contemplated that the burner tube assembly 212 and the thermo-electric device 202 may be received in either aperture 250, 252 as desired. In some instances, the second aperture 252 may be sized to receive two or more components. The pilot burner assembly 200 may include a spacer 214 positioned between the third plate 236 of the bracket 230 and a resilient clip 210. The spacer 214 may include a first aperture 258 configured to receive the thermo-electric device 202 and a second aperture 264 configure to receive an additional component. It is contemplated that the spacer 214 may maintain the proper orientation of the thermo-electric device 202 relative to the other components. The resilient clip 210 may secure the spacer 214 to the bracket 230.

In some embodiments, the burner tube assembly 212 may be formed of multiple components including, for example, a pilot hood 218, a collar 222, a burner tube 226, and a compression fitting 228. Collar 222, which provided, may be similar in form and function to collar 22 discussed above. The pilot hood 218 may include a first hood portion 260 and a second tubular portion 262 extending away from the first hood portion 260. The pilot hood 218 may be movably secured to the burner tube 226 using the collar 222 and a retaining member 224. This may allow the orientation of the pilot hood 218 to be adjusted in the field based on a given application. To assemble the burner tube assembly 212 with the bracket 230, the burner tube 226 may be advanced through aperture 250 such that a first end of the 226 extends through the aperture 250. Once the burner tube 226 is positioned, collar 222 may be disposed over the first end of the 226 such that the first end is disposed within a lumen of the collar 222. In some embodiments, the collar 222 may have a larger cross-section than a cross-section of aperture 250. This may help prevent the collar 222 from passing through aperture 250. The tubular portion 262 may then be positioned within the lumen of the collar 222 and a lumen of the burner tube 226. Alternatively, it is contemplated that the pilot hood 218 may be assembled with the collar 222 prior to placing the collar 222 over the burner tube 226. In some instances, the tubular portion 262 of the pilot hood 218 may include a slot or recess (not explicitly shown). This may allow the tubular portion 262 to compress as it is advanced into the collar 222 and burner tube 226, thus providing a snug friction fit or press fit to help secure the pilot hood 218 in place. In some embodiments, the pilot hood 218 may include a tab or protrusion 254 extending from the tubular portion 262. The tab 254 may be configured to engage the collar 222 to prevent the pilot hood 218 from being further advanced within the collar 222 and 226. This may help maintain the vertical alignment of the pilot hood 218. Once the pilot hood 218 has been positioned within the collar 222 and 226, the pilot hood 18 may be rotated such that the flame is directed towards a desired location.

One or more apertures 240 in the collar 222 may generally align with one or more apertures in the burner tube 226. Once the pilot hood 218 is disposed within the burner tube 226, the pilot hood 218 may be rotated or otherwise moved to a desired orientation. A set screw 224 may then be secured within aperture 240 and the aperture in the burner tube to retain the pilot hood 218 in the desired configuration. The set screw 224 may extend through the collar 222 and the burner tube 226 to contact the pilot hood 218 to hold the pilot hood 218 in the desired position. While there are two apertures 240 illustrated in the collar 222, the orientation of the pilot hood 218 may not be limited by which aperture the set screw 224 engages. As the tubular portion 262 of the pilot hood 218 does not include apertures, the set screw 224 may frictionally engage the outer surface of the tubular portion 262 to retain it in any orientation desired. If it is desired to reposition the pilot hood 218, the set screw 224 may be loosed and/or removed and the pilot hood 218 repositioned. In some instances, the diameter of the tubular portion 262 of the pilot hood 218 may be similar in size or slightly larger than the diameter of the lumen of burner tube 226. This may result in a friction or press fit between the pilot hood 218 and the burner tube 226 to help secure the pilot hood 218. In other instances, the diameter of the tubular portion 262 of the pilot hood 218 may be smaller than the diameter of the lumen of the burner tube 226.

It is contemplated that the pilot hood 218 may be positioned such that it faces front, left, or right. These are just examples. While the pilot hood 218 is described as being positioned in three discrete positions, it is contemplated that the pilot hood 218 may be positioned at any orientation desired (infinitely adjustable). In some instances, the set screw 224 may be secured to a different location of the collar 222 and burner tube 226. This may allow the installer to select the aperture 240 that is most readily accessible to secure the pilot hood 218.

Those skilled in the art will recognize that the present disclosure may be manifested in a variety of forms other than the specific examples described herein. Accordingly, departure in form and detail may be made without departing from the scope and spirit of the present disclosure as described in the appended claims.

What is claimed is:

1. A field configurable burner tube assembly for a pilot burner, comprising:

a burner tube;

a pilot hood;

wherein the pilot hood is securable in any of two or more different orientations in the field via a set screw, the two or more different orientations being within 90° or less of one another;

a thermo-electric device;

a bracket for carrying the pilot hood and burner tube adjacent to the thermoelectric device, wherein the bracket has a first side and a second side with an aperture extending between the first side and the second side, the burner tube positioned on the first side of the bracket with an end portion of the burner tube extending through the aperture, a collar positioned on the second side of the bracket, and including an aperture extending through the collar with the end portion of the burner tube extending into the aperture of the collar;

the end portion of the burner tube including an aperture configured to accept and engage at least part of the pilot hood; and wherein the set screw extends through a set screw hole in the collar, through a set screw hole in the end portion of the burner tube and rests against part of the pilot hood that is accepted by the aperture in the burner tube.

2. The field configurable burner tube assembly of claim 1 wherein the set screw frictionally engages the pilot hood to frictionally secure the pilot hood relative to the collar.

3. A field configurable burner tube assembly for a pilot burner, comprising:

a burner tube;

a pilot hood;

a set screw;

wherein the pilot hood is positioned in any of three or more different orientations relative to the burner tube via the set screw;

a thermo-electric device;

a bracket for carrying the pilot hood and the burner tube adjacent to the thermoelectric device, the bracket having a first side and a second side with an aperture extending between the first side and the second side;

the burner tube is positioned on the first side of the bracket and has an end portion that extends through the aperture in the bracket and past the second side of the bracket, the end portion of the burner tube including an aperture configured to accept at least part of the pilot hood; and a collar is positioned on the second side of the bracket and engages at least part of the end portion of the burner tube and is secured relative to the burner tube via the set screw, the collar including an aperture extending through the collar, with the end portion of the burner tube extending into the aperture of the collar;

wherein the set screw extends through a set screw hole in the collar, through a set screw hole in the end portion of the burner tube and rests against part of the pilot hood that is accepted by the aperture in the burner tube.

* * * * *